US005623735A

United States Patent [19]

Perry

[11] Patent Number: 5,623,735

[45] Date of Patent: Apr. 29, 1997

[54] SUSPENDER TO BE WORN WITH A BELT

[76] Inventor: Don A. Perry, 742 Wolf Rd., Decatur, Ill. 62526

[21] Appl. No.: 591,102

[22] Filed: Jan. 25, 1996

Related U.S. Application Data

[63] Continuation of Ser. No. 262,245, Jun. 17, 1994, abandoned.

[51] Int. Cl.[6] ..... A41F 3/00

[52] U.S. Cl. ..... 2/327; 2/326

[58] Field of Search ..... 2/327, 326, 319, 2/310, 311, 312, 340, 338

[56] References Cited

U.S. PATENT DOCUMENTS

| | | | |
|---|---|---|---|
| 87,648 | 3/1869 | Demorest et al. | 2/327 |
| 287,020 | 10/1883 | Greely | 2/326 |
| 957,117 | 5/1910 | Snow | 2/319 |
| 2,053,169 | 9/1936 | Stork | 2/310 |
| 2,315,698 | 4/1943 | Gluckman | 2/340 |
| 2,437,714 | 3/1948 | Thomason, Jr. | 2/310 |
| 2,834,022 | 5/1958 | Heyman | 2/340 |

FOREIGN PATENT DOCUMENTS

| | | | |
|---|---|---|---|
| 641101 | 7/1928 | France | 2/340 |
| 237630 | 11/1925 | Switzerland | 2/340 |

*Primary Examiner*—C. D. Crowder
*Assistant Examiner*—Gloria Hale
*Attorney, Agent, or Firm*—Philip L. Bateman

[57] ABSTRACT

A pair of suspenders is worn to support pants having a belt threaded through a plurality of belt loops. The suspenders contain a pair of straps that are worn over the shoulders. A connector is attached at each end of each strap for hooking the suspenders onto the bottom of the belt. Each connector has a side cross-sectional shape of a hook, a front vertical portion defining a plane extending upward from the bottom of the belt to a point above the top of the belt, and a back vertical portion defining a plane extending upward from the bottom of the belt to a point about the top of the belt.

3 Claims, 2 Drawing Sheets

SUSPENDER TO BE WORN WITH A BELT

CROSS-REFERENCE TO RELATED APPLICATION

This application is a continuation of U.S. patent application Ser. No. 08/262,245, filed Jun. 17, 1994, now abandoned.

FIELD OF THE INVENTION

This invention relates to articles of clothing. More particularly, this invention relates to suspenders.

BACKGROUND OF THE INVENTION

Pants are outer garments covering the body from the waist to the ankles with separate sections for each leg. Pants are also commonly known as trousers. When a person's waist is considerably smaller than his hips, pants will stay in position provided the waistline fits reasonably snugly. However, many persons have waists that nearly equal, or even exceed, the size of their hips. To hold their pants in position, these persons must use belts and/or suspenders.

A belt is an adjustable band which is worn tightly around the waist. Most pants contain a series of belt loops sewn around the outside of the waist. The belt is threaded through the belt loops and then secured. Suspenders are straps which are worn over the shoulders and fastened to the pants, either to buttons sewn on the inside waistband or to the top edge of the pants using clips. Suspenders are very effective at supporting pants, but are subject to several inconveniences. If the wearer has a garment on top of the straps (for example, a jacket or sweater) and wants to drop his pants, he must either remove the outer garment or disconnect the suspenders from his pants. The vast majority of pants sold in the United States are made to be worn with belts and/or suspenders. Earlier in this century, suspenders were the primary means of supporting dress pants. Belts have gradually replaced suspenders, but it is still common for men to wear both belts and suspenders with dress pants.

While the use of belts and/or suspenders supports the pants, persons with large, protruding stomachs continue to experience an additional problem. The shape and size of their stomachs tend to force the top of their pants outward. In many cases, the top of the pants actually folds over, creating an unsightly and embarrassing situation.

A number of different suspenders have been disclosed, but none exerts an inward force to prevent the top of the pants from folding over and none enables the wearer to easily drop his pants while wearing a garment on top of the suspenders. For example, Snow, U.S. Pat. No. 957,117, issued May 3, 1910, and Thomason, Jr., U.S. Pat. No. 2,437,714, issued Mar. 16, 1948, disclose suspenders which can be attached to any type of belt by threading the belt through the suspender loops. Stork, U.S. Pat. No. 2,053,169, issued Sep. 1, 1936, discloses a trousers support having fasteners which are clipped into a locking position to a belt in a manner similar to the locking of a safety pin.

SUMMARY OF THE INVENTION

The general object of this invention is to provide an improved pair of suspenders. A more particular object is to provide a pair of suspenders which can be easily connected and disconnected so that a person wearing an outer garment over his suspenders can easily drop his pants without removing the garment. A second more particular object is to provide a pair of suspenders which prevents the top of the pants from folding over when worn by a person with a protruding stomach. A third particular object is to provide a pair of suspenders which can be used with any pants worn with a belt, regardless of the width of the belt. The present invention is a pair of suspenders for supporting a wearer's pants worn with a belt threaded through a plurality of belt loops at the waist of the pants. The suspenders comprise: (a) a pair of straps, each of which is adapted to be worn over a shoulder and to extend down the front and back of the trunk of the wearer; (b) a connector attached at each end of each strap for hooking onto the bottom of the belt. Each connector has: (i) a side cross-sectional shape of a hook; (ii) a front vertical portion defining a plane extending upward from the bottom of the belt to a point about one-half to three inches above the top of the belt; (iii) a back vertical portion defining a plane extending upward from the bottom of the belt to a point about the top of the belt; (iv) the distance between the front portion and the back portion being at least the thickness of the belt; (v) each connector being attached to the strap at the top of its front vertical portion; such that the suspenders provide an uplifting force to the belt which force is, in turn, provided to the pants, and such that the connectors of the suspenders provide an inward force against the top of the belt and the top of the pants to resist any tendency of the top of the pants to fold over because of the protrusion of the wearer's stomach.

DETAILED DESCRIPTION OF THE INVENTION

Figure 1:
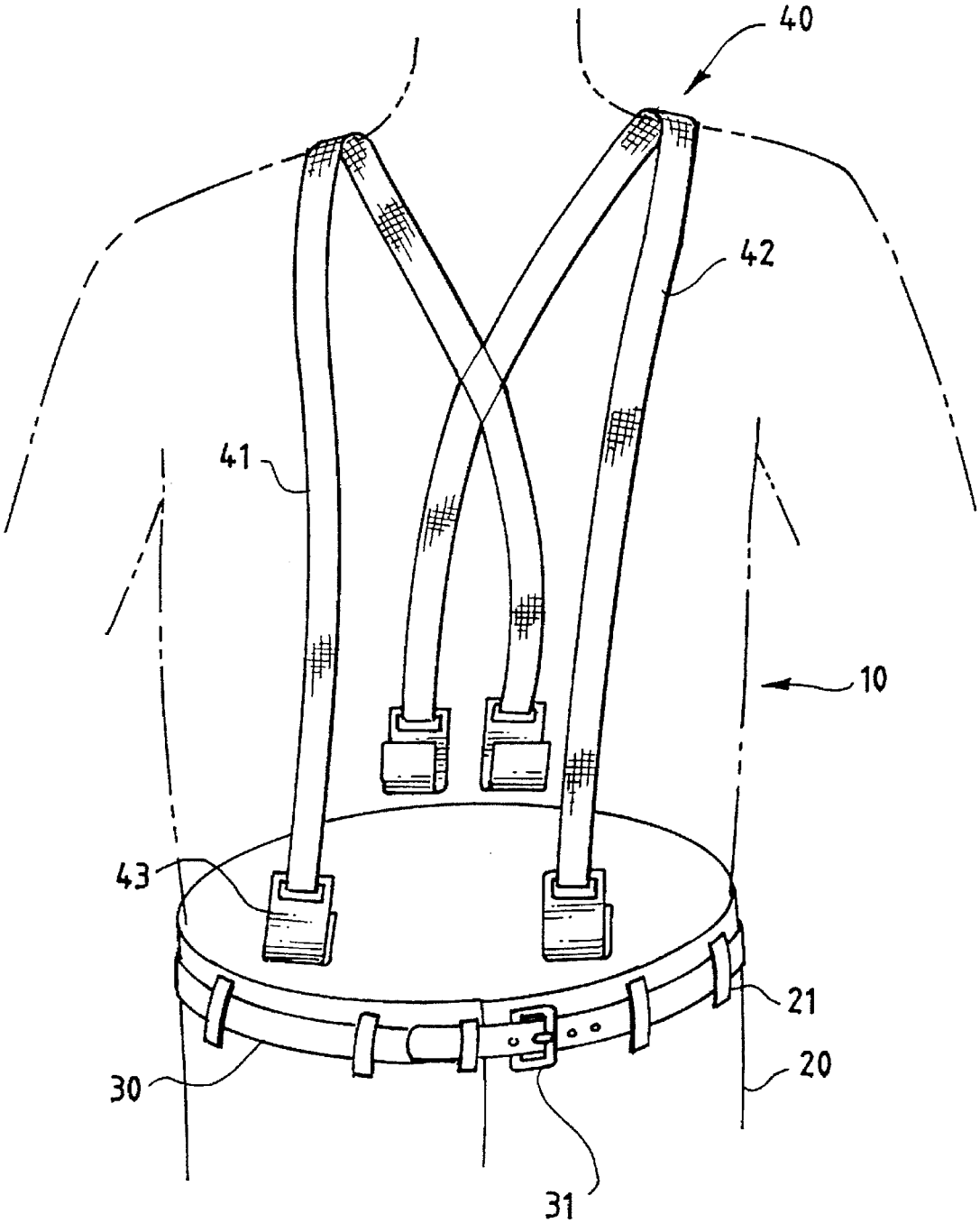
FIG. 1 is a perspective view of one embodiment of the suspenders of this invention.

This invention is best understood by reference to the drawings. FIG. 1 shows a man 10 wearing a pair of pants 20 having belt loops 21 sewn around the outside of the waist. A belt 30 having a conventional buckle 31 is threaded through the belt loops and buckled. A pair of suspenders 40 is shown in a position draped over the shoulders and unattached to the belt, as if the suspenders were in the process of being put on.

The suspenders contain two straps 41 and 42 which pass over each shoulder. The straps of the suspenders of this invention are conventional. They are typically connected at the middle of the back so they are kept in the alignment necessary to prevent the straps from sliding down off the shoulders. Connecting the straps also prevents them from being inadvertently separated from each other. The straps are generally made of an elastic material having a width of about one inch.

Connectors 43 are attached at each end of each strap. As explained below, each strap is attached to the front vertical portion of the connector. The term "front," when used with a connector, refers to that part of the connector facing outwardly, away from the wearer. In all other respects, the manner in which the straps are attached to the connectors is not critical to this invention. One convenient manner is shown in FIG. 1. The end of the strap is passed through a slot in the front of the connector and then double-backed over the strap to form a loop and sewed. An alternate manner is to attach the straps to the connectors with rivets or the like. Another alternative is to use snaps, buttons, or the like so that the connectors can be easily removed from the straps to permit the interchange of straps and connectors. The manner of attachment preferably permits the straps some side-to-side movement so that the connectors stay in a nearly vertical position regardless of where they are connected to the belt.

The connectors hook around the bottom of the belt and are held in place by the tension on the straps between the shoulders and the belt. The connectors are shown hooked to the belt in FIGS. 2, 3, and 4. The connectors have a side cross-sectional shape of a hook, i.e., having a shank portion and a barb portion as shown most clearly in FIG. 4. The connectors are preferably attached to the belt at the four locations (two in front and two in back) below the point at which the straps pass over the shoulders.

Each connector has a front vertical shank portion 44 which defines a plane. This portion is generally a thin, flat piece of material as shown in the FIG. 2 embodiment. An alternative is the wire framework shown in FIG. 3. In any event, this front vertical portion extends upwardly from the bottom of the belt to a point about one-half to three inches above the top of the belt. Most belts have a width of about one-half to two inches so the height of the front vertical portion is generally about one to five inches. The height of the front vertical portion is preferably about two to four inches. The front vertical portion preferably has a width of about one to two inches.

Each connector also has a back vertical barb portion 45 which defines a plane. The back portion is similar to the front portion except for its height. The back portion extends upwardly from the bottom of the belt to a point about the top of the belt. The back portion typically has a height of about one-half to two and one-half inches, preferably about one to two inches.

The distance between the front portion and the back portion of the connectors is at least the thickness of the belt, or at least about one-eighth inch. The transition between the front and back portions is preferably a smoothly curved semicircle.

Because the connector is separated from the body by only one or two relatively thin layers of clothing, it is highly desirable that all its surfaces be smooth and free of sharp or jagged edges which could tear clothing or be uncomfortable to the wearer.

The connectors are made of a suitably rigid material such as metal, plastic, wood, or ceramic. The external appearance of the connectors can be made as plain or as ornamental as desired or as dictated by fashion. For example, the connectors can match the color, material, and style of the belt buckle.

It can be seen that the suspenders of this invention are easily hooked to, and unhooked from, the belt, regardless of the width of the belt. This feature enables the suspenders to be used with any pants being worn with a belt. This feature also greatly simplifies the wearer's procedure for dropping his pants while wearing an outer garment on top of the suspenders. There is no need to remove the outer garment to slip the suspender straps down and under the arms—the straps are left in place on the shoulders and the connectors simply unhooked from the belt. When the pants are put back on, the connectors are easily rehooked.

Figure 4:
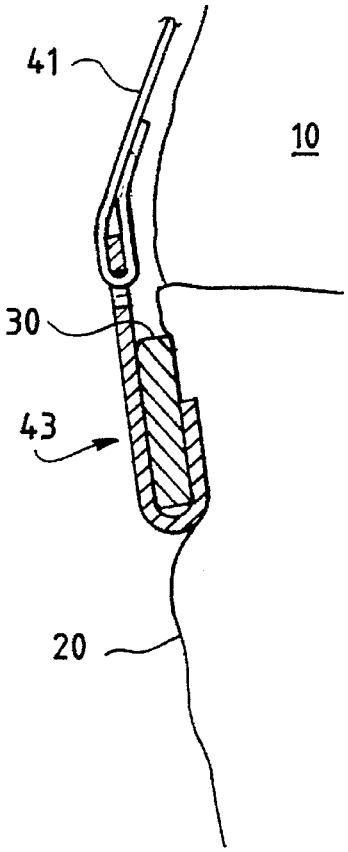
FIG. 4 is a side sectional view of one embodiment of the suspenders of this invention.

FIG. 4 illustrates how the suspenders of this invention prevent the top of the pants from turning over. The wearer's protruding stomach tends to force the top of the pants out and over. This effect is magnified when the wearer sits down. But the connectors exert an inward force against the top of the belt and the top of the pants. The forces against the belt are, in turn, distributed more evenly around the waist by the belt.

Figure 2:
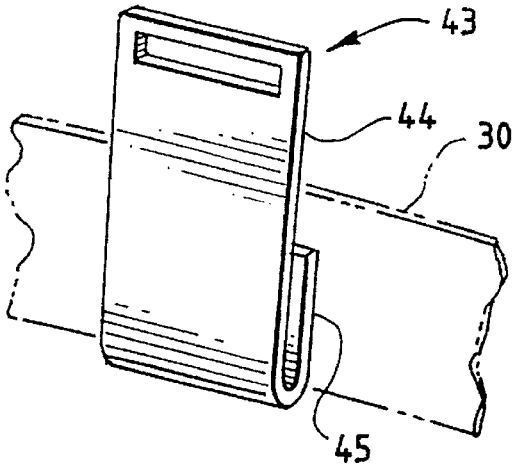
FIG. 2 is a detailed perspective view of one of the connectors of the suspenders shown in FIG. 1.
Figure 3:
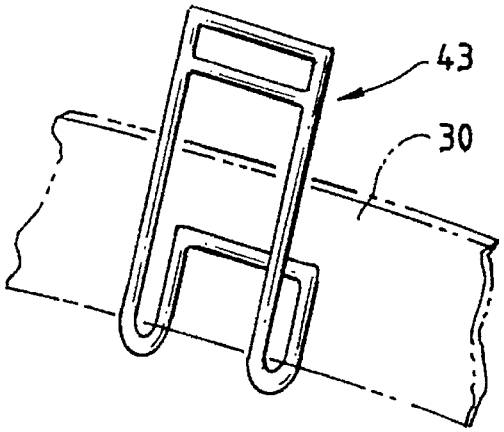
FIG. 3 is a detailed perspective view of a second embodiment of the connectors.

It is preferred that all the connectors be of the type shown in FIGS. 2 and 3. However, the front two connectors are the most important in preventing the top of the pants from folding over. Therefore, it is possible to realize most of the advantages of the connectors of this invention by employing them only on the front and to use conventional connectors (clips or buttonholes) on the back connectors.

I claim:

1. A method of supporting a wearer's pants worn with a belt threaded through a plurality of belt loops at the waist of the pants, the method comprising:

(a) obtaining a pair of suspenders comprising:

(i) a pair of straps, each of which has two sides and two ends, each of which straps is adapted to be worn with one side facing inward against the body of the wearer and with the other side facing outward, each of which straps is further adapted to be worn over a shoulder of the wearer and to extend down the front and back of the trunk of the wearer; and (ii) a connector at each end of each strap, each connector being made of a rectangular piece of rigid material having a length of about 3 to 6 inches formed into the shape of a hook by having a curved bend of about 180° such that a shank portion has a length of about 2 to 4 inches and a barb portion has a length of about 1 to 2 inches, each connector being attached to the strap at the shank portion at a location opposite the curved bend and in a fixed orientation relative to the strap such that the shank portion faces outward and the barb portion faces inwardly;

(b) placing the straps of the suspenders over the shoulders of the wearer; and (c) hooking the connectors onto the belt with the shank portion facing outward so that an uplifting force is provided to the belt, which force is, in turn, provided to the pants; and so that the connectors provide an inward force against the belt and the pants to resist any tendency of the top of the pants to fold over because of the protrusion of the wearer's stomach.

2. The method of claim 1 wherein each connector is the same.

3. The method of claim 2 wherein the straps of the suspenders are attached to the connectors by looping through a slot in the connectors.

* * * * *